United States Patent [19]

Pallis

[11] 4,332,284

[45] Jun. 1, 1982

[54] KEY CHAIN WALLET

[76] Inventor: Christopher N. Pallis, 3741 81st SE., Mercer Island, Wash. 98040

[21] Appl. No.: 167,925

[22] Filed: Jul. 14, 1980

[51] Int. Cl.[3] ..... A45C 11/32

[52] U.S. Cl. ..... 150/35; 150/40

[58] Field of Search ..... 150/3, 28 R, 30, 35, 150/37, 38, 39, 40, 34, 42; 206/38; 190/52; 70/456 R, 457

[56] References Cited

U.S. PATENT DOCUMENTS

| | | | |
|---|---|---|---|
| 1,699,865 | 1/1929 | Walton | 150/40X |
| 1,821,585 | 9/1931 | Smith | 150/39 |
| 2,066,526 | 1/1937 | Gladstone | 150/40 |
| 2,285,154 | 6/1942 | Lewellen | 150/40 |
| 2,429,856 | 10/1947 | Vasquez | 150/28 R |
| 2,470,367 | 5/1949 | Palma | 150/37 |
| 2,508,825 | 5/1950 | Lewis | 150/28 R X |
| 2,533,850 | 12/1950 | Syracuse | 190/52 UX |
| 2,573,766 | 11/1951 | Hyman | 150/28 R |
| 3,261,387 | 7/1966 | Cass | 150/37 |

*Primary Examiner*—Donald F. Norton

*Attorney, Agent, or Firm*—Cole, Jensen & Puntigam

[57] ABSTRACT

A key case and wallet unit combined, for carrying a plurality of keys together with driver's license, and a limited number of credit cards and currency, including coins. The case is comprised of two sections adjacent to each other such than an inner flexible dividing wall common to both sections separates each compartment. The inner flexible dividing wall is of flexible material and is received between and separates both outer walls where the inner flexible dividing wall and the outer flexible dividing walls are bound together.

The key case section includes an outer flexible wall provided with a zipper closure in the midsection of that wall. A key ring is attached to the outer flexible wall by means of a material used from the cutting of that wall from which the zipper closure was formed. Separating this section from the adjacent section, is the forementioned inner flexible dividing wall. The adjacent section includes an outer flexible wall provided with a zipper closure located near the top of the wall for the purpose of allowing a driver's license, credit cards and currency, including coins, to be stored.

2 Claims, 6 Drawing Figures

KEY CHAIN WALLET

BACKGROUND OF THE INVENTION

The present invention relates to key cases and in particular, a case for carrying a plurality of keys in addition to driver's license, a limited number of credit cards and currency, including coins.

There are currently many types of key cases available, though in general, such cases are designed for the specific purpose of carrying keys, and are not designed to receive other items such as a driver's license, credit cards, and currency. Many key cases available do not allow the removal of all the keys at once, since each key is often attached to the carrying case individually. As a result, conventional key cases are often carried in addition to wallets, pocket books and hand bags.

Some carrying cases such as wallets have a provision for carrying a key, but do not provide for carrying a plurality of keys on a key ring.

Larger carrying cases such as pocket books and handbags provide ample carrying space, but are disadvantageous in that they are often over compartmentalized, are often too bulky and not able to fit in a garment pocket, or cause bulges in one's clothing and are uncomfortable.

With the present invention, an individual may carry only the essential items needed, while eliminating unnecessary items stored in bulkier carrying cases.

SUMMARY OF THE INVENTION

The primary objective of the present invention is to provide an improved pocket size key case of minimum size and thickness, which can be used in carrying a plurality of keys in addition to a driver's license, a limited number of credit cards, currency and coins, yet allowing a means of carrying these essential items in only one carrying case.

Another object of the invention is to provide a key case from which the key ring need never be separated from the carrying case, although this may easily be done if necessary.

A further object of the invention is to provide a multipurpose key case of very simple construction, yet most durable in nature.

Generally, the key case section of the invention comprises a generally rectangular exterior flexible wall, provided with a zipper closure in the midsection of the wall for the purpose fo allowing keys to be stored when not in use. A key ring is attached to the exterior flexible wall by means of material used from the cutting of that wall from which the zipper closure was formed.

Separating this section from the adjacent section is an interior flexible dividing wall, common to, and separating both compartments. The interior flexible dividing wall is comprised of a generally rectangular sheet of flexible material and is received between both exterior flexible walls where the peripheries of the inner flexible dividing wall and exterior flexible walls are secured together.

The adjacent section to the key case includes a second exterior flexible wall provided with a zipper closure located near the top of the wall for the purpose of allowing a driver's license, credit cards and currency, including coins, to be stored.

In the manufacturing of key cases or wallets, it is generally desireable to construct these items as compact as possible in order to afford efficiency and to prevent undue bulkiness in garment pockets. Prior art has provided a means of storing keys in one unit, and other essentials such as driver's license, credit cards and paper currency in a separate unit, and often times even coins in yet another unit.

An advantage of the invention lies in fact that all aforementioned essential items can be carried efficiently and effectively within one unit, while eliminating undue bulkiness found in conventional carrying cases.

These advantages of the invention, together with further objects and advantages will be better understood with reference to the drawings and the detailed description of the drawings which follows. It is to be understood, however, that the drawing are for the purpose of illustration and description only, and are not intended as a definition as to the limis of the invention.

DETAILED DESCRIPTION OF THE DRAWINGS

Figure 2:
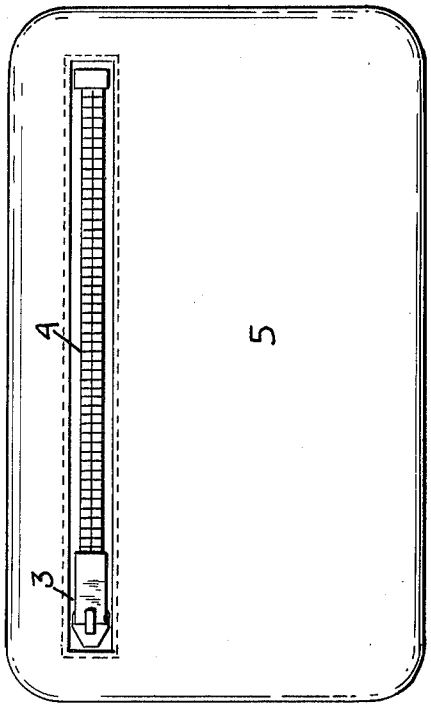
FIG. 2 is a back view of the wallet compartment with the zipper closure shut.
Figure 6:
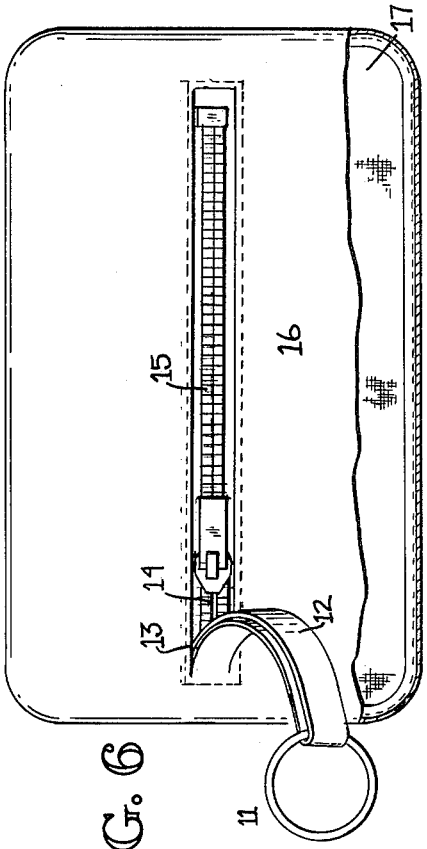
FIG. 6 is a front view of the key case compartment with the leather strap and key ring pulled out of the aformentioned compartment, and showing a cross section of the interior flexible driving wall.
Figure 5:
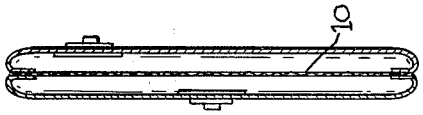
FIG. 5 is a vertical cross section, taken on plane 5—5 of FIG. 1 showing the right end.

The key case section is designated generally in FIG. 6 and the wallet section designated in FIG. 2. The case has these two principle sections, each being adjacent to the other, with both sections being separated by one interior flexible dividing wall 10, 17 common to both sections as best seen in FIG. 5 which shows a vertical cross section taken on plane 5—5 of FIG. 1. The exterior flexible walls 16, 5 can be constructed with natural or simulated leather, fabric or any other suitable material, it being understood that the choice of materials is not a feature of the invention.

Figure 1:
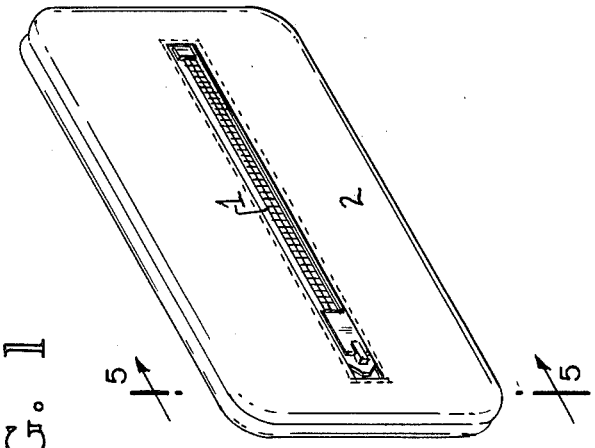
FIG. 1 is an isometric front side view of the invention showing the key case compartment with the zipper closure shut.

The front side of the case 2, 16, showing the exterior flexible wall of the key case section as best seen in FIG. 1 and FIG. 6, for purposes of description, shall be referred to as the "front side". The opposite side of the case showing the exterior flexible wall of the wallet section 5 as best seen in FIG. 2 for the purposes of description, shall be referred to as the "back side".

The front side as seen in FIG. 6 forming an exterior flexible wall has a strip cut from the midsection of this wall 12, where the left end remains in tact. From this cutting, the zipper closure is formed 1, 15. A portion of the end of this strip is cut to shorten is length, and it is secured into the opposite end from which it was cut, directly underneath the uncut end of the exterior flexible wall 13, thereby forming a looped fixture from which a key ring is attached. The front side zipper is secured into the section from which the stripping was cut, in such a manner, that the zipper opens and closes from the left end, 14, of the front side allowing the attached key ring, 11 access to the key case compartment, where it is hidden and sealed, as showing in FIG. 1.

Figure 3:
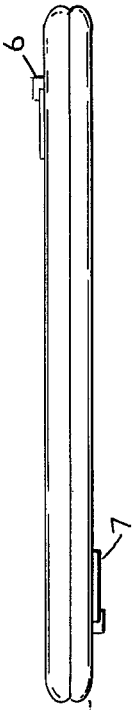
FIG. 3 is a top view of the invention.

The opposite side or back side seen in FIG. 2 has a strip cut from the top section of this wall, where no end remains in tact and both ends are completely cut providing space into which a zipper closure is secured, 4. The back side zipper closure is also secured in such a manner that the zipper opens and closes from the left end, 3, of the back side as shown in the top view of FIG. 3 where both zipper closures are seen in their closed positions 6, 7.

Figure 4:
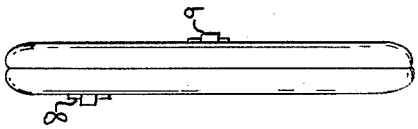
FIG. 4 is a vertical side view of the invention, showing the left end.

A side view of the invention is best seen in FIG. 4 where both front side zipper, 9, and back side zipper, 8, are viewed in relation to their distance from the top side with each zipper positioned to most effectively contain their respective articles.

In order to secure the outer walls and the inner dividing wall, the front side outer wall, 16, and the back side outer wall, 5, are placed on top of each other with the outsides facing in and with the inner dividing wall 10, 17, being placed on top of the back side wall, with all three pieces secured along the peripheries. After all three pieces have been secured, the case is turned right side out through the open zipper section.

While the descriptions of the invention have been illustrated in detail, it is apparent that modifications and changes of these descriptions will occur to those skilled in the art. However, it is to be understood that such modifications and changes are within the spirit and the scope of the present invention, as set forth in the following claims.

What is claimed is:

1. An accessory case designed to be carried in a pocket or purse comprising:

a first exterior wall made of a flexible material and including a closeable opening passing through the wall, a second exterior wall made of a flexible material and including a closeable opening passing through the wall, a third wall intermediate the two exterior walls, means securing the three walls together about the periphery thereof whereby a divided case capable of being opened from either side is formed, a strip of material has been cut from the midsection of the first exterior wall with one end of this strip remaining intact and where the cut end is secured to the opposite uncut end of the first exterior wall forming a loop from which a key ring is attached.

2. An accessory case according to claim 1 wherein:

a zipper closure is provided in the first exterior wall enabling keys to be stored when not in use and where the zipper opens and closes at one end of the first exterior wall.

* * * * *